United States Patent [19]

Dixon

[11] Patent Number: 4,811,749

[45] Date of Patent: Mar. 14, 1989

[54] PAINT ROLLER CLEANING DEVICE

[76] Inventor: Allen L. Dixon, 58 N. 300 West, Smithfield, Cache County, Utah 84335

[21] Appl. No.: 95,764

[22] Filed: Sep. 14, 1987

[51] Int. Cl.[4] ..... B08B 3/04

[52] U.S. Cl. ..... 134/184; 134/198; 134/200; 68/213

[58] Field of Search ..... 68/213; 134/136, 184, 134/192, 195, 196, 197, 198, 200; 210/449, 460

[56] References Cited

U.S. PATENT DOCUMENTS

| | | | |
|---|---|---|---|
| 3,608,120 | 9/1971 | Seiler | 68/213 X |
| 4,155,230 | 5/1979 | Lacner, Jr. | 68/213 |
| 4,377,175 | 3/1983 | Fritz | 68/213 X |
| 4,380,478 | 4/1983 | Cooney | 68/213 |
| 4,417,596 | 11/1983 | Pahlen | 68/213 |

*Primary Examiner*—Harvey C. Hornsby

*Assistant Examiner*—Frankie L. Stinson

*Attorney, Agent, or Firm*—M. Ralph Shaffer

[57] ABSTRACT

A paint roller cleaning device wherein such device is suitably constructed for releasably retaining a paint roller for cleaning purposes, and for receiving under pressure fluid flow enabling such cleaning of the paint roller. Permissibly included are helix-like devices for cleaning the interior of the inner tube of the paint roller, the latter of course being provided with an exterior nap surface. Structural means are provided for directing fluid flow in the device in a manner such that fluid flow is directed longitudinally and peripherally through the nap material of the roller to be cleaned. The device is preferably a two-piece structure, the first piece, a cap preferably being threaded over and thus connected to the remaining piece comprising a container of the device.

12 Claims, 2 Drawing Sheets

PAINT ROLLER CLEANING DEVICE

FIELD OF INVENTION

The present invention relates to cleaning equipment for paint rollers and, more particularly, to a new and improved paint roller cleaning device which is uniquely suited for receiving pressurized fluid flow in a manner to clean appropriately a contained paint roller within such device.

BACKGROUND OF INVENTION AND BRIEF DESCRIPTION OF PRIOR ART

For artisans, professional painters, and do-it-yourself property owners or property managers, there is the ever present problem of keeping up with refurbishing chores in connection with painted or otherwise finished surfaces i.e. walls, ceilings, and so forth, or of simply finishing new walls and the like. The term "paint" in "paint roller" as used herein refers to any type of liquid, be the same an enamel paint, a latex-type paint, stains, and so forth, in other words any type of liquid that is or can be used by a roller for application of the same to a surface to be finished.

Commonly, paint rollers include an inner tube and an outer nap secured to such tube by an appropriate adhesive or by other means. The nap may be a carpet-like material, can be tufted, fibrous, or form any type of outer covering that is suitable to carry and apply paint or other finishing materials. The usual paint applicator includes a revolvable cylinder member and a handle secured thereto, the revolvable cylinder member being inserted in the inner tube of the paint roller for rotatable advance of the latter over a wall or other surface to be finished. There are several procedures extant for cleaning the roller once the same has been used; a common step is to remove the paint roller from the applicator and either dip the same in a pail of solvent or other cleaning medium, swishing the same about until the nap is essentially free of the paint used. Familiar to householders is the chore of hosing off the paint roller and shaking the same out over an unused yard area; frequently the hand must be used to "twist out" the solvent carrying paint roller so that the same is freed of the paint and allowed to dry. This is a somewhat messy operation and, furthermore, the roller is not likely to become very clean.

Another approach is of course to discard the paint roller and buy a new one. This is expensive, particularly for high-quality rollers with fluffy naps that are used for applying various textures to walls and ceilings.

While closable storage devices are known, for temporarily storing wet paint rollers for a period of time against immediate dry-out by ambient air, no devices are known to the inventor nor is their present acquaintance with any patent literature, teaching a method or structure for cleaning paint rollers by use of a device according to the present invention which utilizes pressurized fluid flow through such device and in a manner to advantageously clean the nap of the roller.

BRIEF DESCRIPTION OF PRESENT INVENTION

The fundamental inventive concept herein resides in the provision of a paint roller receptacle or container, wherein the latter is suitably designed for receiving an onrush of pressured liquid and permitting the same to clean in a satisfactory manner a paint roller disposed within the receptacle. The device herein includes a container and a cap releasably joined thereto, preferably by a threaded connection. An inlet port is suitable to coupling to a source of pressured fluid such as a water hose, merely by way of example. The device is constructed to receive a used paint roller which is to be cleaned from the wet paint disposed in the nap of the roller once the same is used. The interior structure of the device is engineered so that incoming fluid is routed longitudinally and peripherally through the nap of the roller so that such fluid will carry off the paint laden in the nap so that the solvent used can be discarded or simply stored. A helix-like object is preferably disposed within the interior of the paint roller so that the same can revolve under pressure of the inlet fluid to clean the interior of the inner shell or tube of such roller. Outlet orifices or ports are disposed in the container so as to provide for the automatic ejection of solvent once the same has performed its purpose of removing paint from the roller nap. Unique space remains are provided for space in the roller within the device so as to rely for adequate fluid flow. Optionally used are cylinder means for confining the space receiving the paint roller to that sufficient to direct fluid flow straight through the nap rather than deviating therefrom to an area substantially exterior thereto.

OBJECTS

Accordingly, a principal object of the present invention is to provide a new and improved paint roller cleaning device.

A further object is to provide a paint roller cleaning device wherein the onrush of incoming fluid such as a solvent, or even water, may be appropriately directed longitudinally through and about the nap of a roller so that the latter may be suitably clean.

A further object is to provide cylindrical space remains within a paint roller cleaning device so as to fill up this space between the nap of the roller and any exterior wall so that incoming fluid is directed essentially exclusively through the nap of the material to outlet porch port provided.

A further object is to provide a helix-like device for cleaning the interior of the inner tube of a paint roller.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings in which:

BRIEF DESCRIPTION OF THE DRAWINGS

in FIG. 4 a plug is used to plug off the interior of the paint roller, and in FIG. 5 a space remains is used for delimiting the circumferential width of the space accommodating the paint roller nap such that fluid flows directly through such nap.

DETAILED DESCRIPTION OF PREFERRED EMBODIMENTS

In the present invention the paint roller may be thought of as an inner tube to which an outer-paint applicator layer is affixed, as by an adhesive or other means. This applicator layer comprises a nap, which may be of tufted material, of carpet-like material, of fibrous material, and so on. The term paint as used herein will include any type of coating application be the same an enamel paint, a water-based or latex paint, stains, lacquers, and so forth. The solvent may comprise a water, as for latex paint, mineral spirits, turpentine, paint thinner, alcohol, and so forth.

Figure 1:
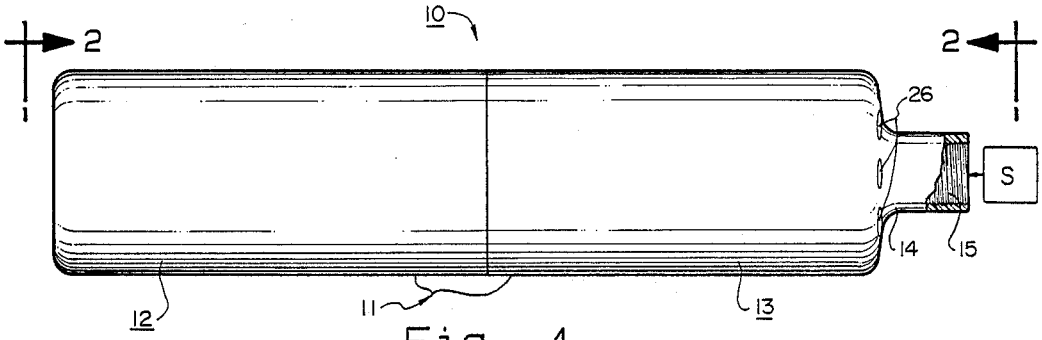
FIG. 1 is a side elevation of a paint roller cleaning device constructed in accordance with the principles of the present invention.
Figure 2:
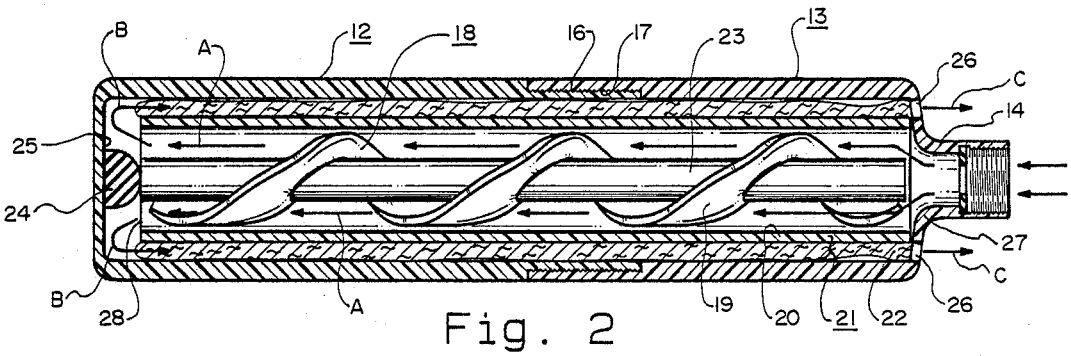
FIG. 2 is a longitudinal cross-section of the device of FIG. 1 illustrating the interior of the device, the augur-like member contained therein shown in side elevation.

In FIG. 1 paint roller cleaning device 10 comprises a receptacle 11 which is composed of a container 12 and also a cap 13. In FIG. 1 the cap 13 is cylindrical, elongated, and provided with an inlet port extension 14 that is internally threaded at 15. Container 12 and cap 13 are mutually threaded at areas 16 and 17 respectively, for supplying a threaded juncture intermediate the ends of the receptacle. Disposed interiorly of the combination of container 12 and cap 13 is a helical member 18 which, in the embodiment shown in FIG. 2, takes the form of an auger which is shortened at its ends and relieved proximate its auger flight 19 to aid the revolvement of the helical member within the inner tube 20 of paint roller 21. The latter, of course, will include the exterior peripheral nap 22 which will be fibrous, carpet-like, tufted or have any other conventional applicator texture as is common to rollers for painting objects such as walls, ceilings, and the like. The helical member 18, being provided its auger flight 19, may also include a central core or central tube 23 to which the helical flight 19 will be secured as by soldering, welding, by a molding process, or by other suitable means. An elongate transverse bead 24 is affixed or simply rests against the base surface 25 of container 12. Cap 13 in FIG. 2 is provided with a series of apertures 26 proximate the head portion 27 of cap 13, head portion 27 forming the base for inlet 14. The purpose for the inclusion of bead or riser 24 is to space the roller end 28 from base surface 25, this to provide for fluid flow along the direction of arrows A. Such fluid flow, as seen in FIG. 2 traverses in a leftward direction and then proceeds to the right to enter the nap material, proceeding there through from left to right, completely through the nap in a longitudinal and circumferential direction whereby to finally exit out of apertures 26.

In operation as to the embodiment shown in FIGS. 1 and 2, the cap 13 is removed and the wet paint roller 21 is installed in the position shown in FIG. 2. Thereafter the cap 13 is replaced by being screw-threaded over the threaded portion of container 12. In a preferred form of the invention, in FIG. 2, the helical member 18 is preliminarily introduced within the hollow core or tube 20 of the paint roller, just prior to the re-installation of cap 13.

In any event, a water supply such as a hose is threaded onto inlet port 14 and water or other solvent medium is pressure fed through inlet port 14 into the interior of the receptacle. This action, as per liquid flow in the direction of arrows A, will rotate the auger so that the auger flight will tend to remove any paint build up on the interior of the hollow paint tube. The solvent in proceeding in the direction of arrows A will loop radially about the left end of the paint roller 25 and proceed as along arrows B into the roller nap. Thereafter, and owing to the pressure applied to the inlet liquid, liquid will flow along arrows B to exit at arrow C once the entire length of the nap has been traversed by the liquid. The course of this liquid flow will carry with it any paint within the nap so as to leave the nap essentially clean and free of paint residue.

By the term "paint" herein is meant any medium that is employed to sise, or condition walls such as undercoats, enamel base paints, latex paints, all water-based applications, and so forth.

Figure 3:
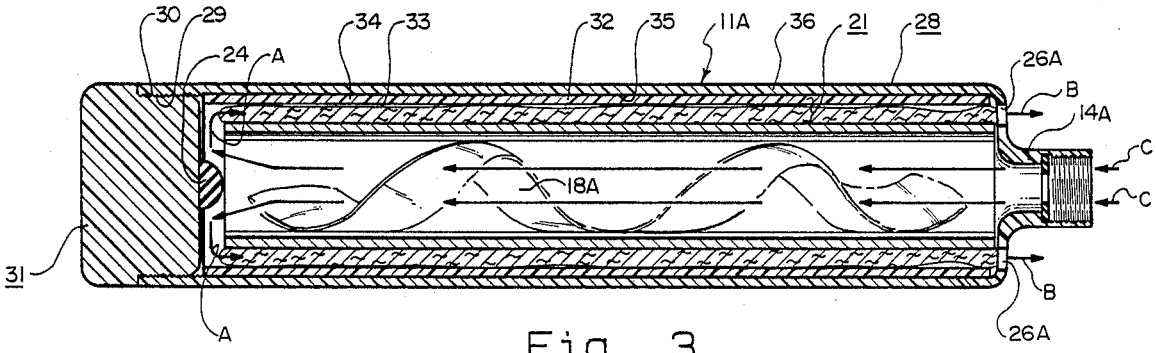
FIG. 3 is similar to FIG. 2 but illustrates a modification of the invention.

In FIG. 3, the receptacle, identified as 11A, now employs a container 28 which is formed similarly to cap 13 in FIG. 2. Container 28 is interiorly threaded at 29 to cooperate with the threads 30 of cap 31. Cap 31 this time takes the form of a plug, the same being provided with, or at least abutting the bead 24 in FIG. 3. Apertures 26A are provided in the container and correspond to apertures 26 in FIG. 2, the structure for the inlet port at 14A in FIG. 3 is similar to that of inlet port 14 in FIG. 2. In FIG. 3 there is provided an auxiliary sleeve 32 which takes the form of a cylinder that abuts opposite interior ends of the receptacle structure. This interior sleeve serves as a spacer between the outer surface 33 of nap 34 of the roller and the interior surface 35 of wall 36 comprising a major portion of the container 28. This spacer sleeve 34 serves to accommodate undersized rollers so as to constrain liquid flow through the nap of the roller rather than through the space peripherally thereabout.

Again, the bead 24 spaces the left end of the roller from the plug 31 so that solvent, i.e. water, or other liquid will flow in the directions of the arrows A through the left end of the nap toward the right end thereof, to be expelled at arrows B out of apertures 26A.

In operation as to FIG. 3, the paint roller is placed in position and the container 28 is threaded onto the cap or plug 31. Liquid is applied under pressure at arrow C, such liquid being in the form of a suitable solvent. The liquid under pressure proceeds under the arrows indicated, centrally and within the hollow tube of the paint roller. Such solvent proceeds in a leftward direction over the left end of the paint roller, finally proceeding to the right through the nap to exit the container at arrows B.

Figure 4:
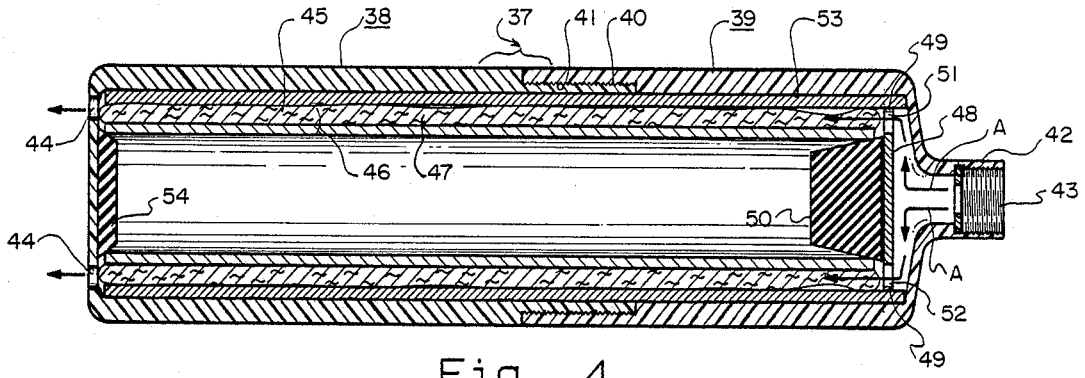
FIGS. 4 and 5 are likewise longitudinal transverse vertical sections of the device, showing other modifications of the invention.

The structure of FIG. 4 illustrates a slightly different configuration of the device wherein the receptacle 37 this time includes container 38 and cap 39, these two members being respectively threaded at 40 and 41 and joined at such threaded areas. An inlet port 42 is provided a container 39 and includes a threaded interior 43 for hose coupling. The container 38 includes end apertures 44 for receiving an expelling such solvent as is forced through the nap 45 of paint roller 46, the latter including interior tube 47 to which the nap is glued or otherwise secured. An interior member 48 has a disk-like flange 49 and also a central interior plug portion 50, the same being constructed to proceed into the right end of the paint roller. Flange 49 includes apertures 51 and 52 for receiving inlet fluid as is indicated by arrows A in FIG. 4. Accordingly, in operation, fluid proceeding under pressure from inlet port 43 travels through apertures 51 and 52, through the nap 45 of the paint roller, and exhausts out of apertures 44 in FIG. 4. For convenience there may be supplied as a sleeve adapter or sleeve spacer a member 53. This is inserted to effect a filling of the space void about the nap where the transverse cross-section of the paint roller is less than the transverse cross- section of the interior of container 38. Such a spacer sleeve serves to constrict solvent flow through the nap in a longitudinal, circumferential or circular pattern so as to exhaust a majority of the paint from the nap.

Figure 5:
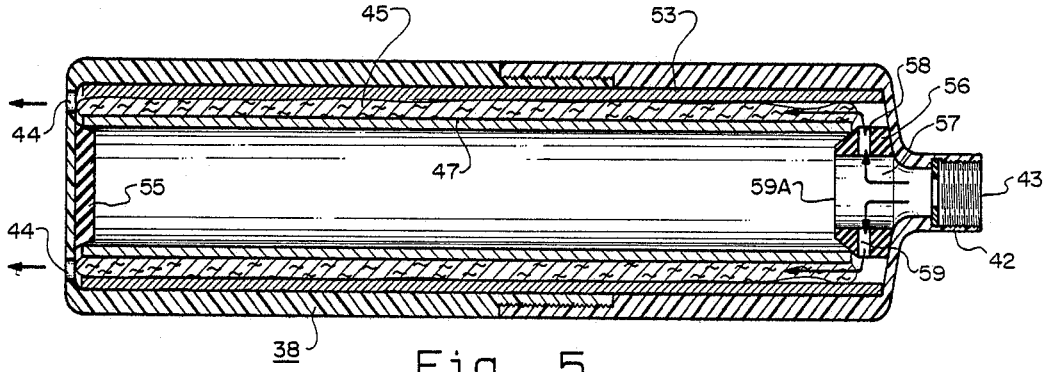

Both FIG. 4 and FIG. 5 illustrate that there may be supplied a cone-shaped gasket or seat at 54 and 55, respectively, for receiving in abutment the left end of the tube 47 of the paint roller.

FIG. 5 illustrates that a further seal seat may be supplied at 56 to make stationary the right-hand portion of the enclosed paint roller. Such a seal seat includes a hollow interior portion 57 and fluid conducting apertures 58 and 59.

In operation, in the structure in FIG. 4, water proceeds to the left through inlet port 43, is deflected by member 48 but proceeds through apertures 51 and 52 to enter the nap area of the receptacle interior, namely, the nap of the paint roller. The liquid solvent proceeds longitudinally through such nap until the same exits at apertures 44. The container 38 in FIG. 5 may be the same as that shown at 38 in FIG. 4. If desired, the member 57 may have a central opening 59A that communicates with the interior of the paint roller. Such fluid as enters therein will be ineffective, however, to perform any function; the point is that the majority of fluid flow will proceed into the interior 57 of member 56 and proceed through the nap area from right to left until the solvent reaches an proceeds out of exhaust apertures 34. It should be noted finally that in lieu of the helical member 18 in FIG. 2, a simple metallic strip 18A that is twisted in the form of a helix may be employed as is seen in dotted line configuration at 18A in FIG. 3.

What is provided in the several embodiments of the invention, therefor, is suitable structure for cleaning a paint roller by the introduction in such structure of a suitable solvent. It should be noted finally that in lieu of the helical member 18 in FIG. 2, a simple metallic strip 18A that is twisted in the form of a helices may be employed as is seen in dotted line configuration at 18A in FIG. 3.

This invention has been described in its presently contemplated best mode, and it is clear that it is susceptible to numerous modifications, modes and embodiments within the ability of those skilled in the are and without the exercise of the inventive faculty. Accordingly, the scope of this invention is defined by the scope of the following claims:

What is claimed is:

1. A paint roller cleaning device comprising a receptacle constructed to releasably receive a paint roller provided with open opposite ends and having a container and a cap, each of said container and cap having threaded connections, said container and cap being releasably secured together at said connections, said cap having a liquid inlet port constructed for connection to a pressurized liquid source and disposed in communication with the interior of said paint roller, and one of said container and cap having at least one liquid outlet port remote from that end of said paint roller which is remote from said liquid inlet port.

2. A paint roller cleaning device comprising a receptacle constructed to releasably receive a paint roller and having a container and a cap, each of said container and cap having threaded connections, said container and cap being releasably secured together at said connections, said cap having a liquid inlet port constructed for connection to a pressurized liquid source, and one of said container and cap having at least one liquid outlet port, and wherein said container has an inner base surface, said container including a transverse, elongate spacer head at said base surface for engaging and thereby spacing an end of said paint roller from said base surface for doubled-back liquid-flow about said end.

3. A paint roller cleaning device comprising a receptacle constructed to releasably receive a paint roller and having a container and a cap, each of said container and cap having threaded connections, said container and cap being releasably secured together at said connections, said cap having a liquid inlet port constructed for connection to a pressurized liquid source, and one of said container and cap having at least one liquid outlet port, and wherein said receptacle has an inner spacer cylinder disposed with the combination of said container and said cap, said spacer cylinder fitting over and against said paint roller.

4. A paint roller cleaning device comprising a receptacle constructed to releasably receive a paint roller and having a container and a cap, each of said container and cap having threaded connections, said container and cap being releasably secured together at said connections, said cap having a liquid inlet port constructed for connection to a pressurized liquid source, and one of said container and cap having at least one liquid outlet port, and wherein said receptacle is provided with a helical member within the combination of said container and said cap, said helical member being for removing paint from the interior of said paint roller.

5. The structure of claim 4 wherein said helical member comprises a helically twisted elongated strip.

6. The structure of claim 4 wherein said helical member comprises an auger.

7. A paint roller cleaning device comprising a receptacle constructed to releasably receive a paint roller and having a container and a cap, each of said container and cap having threaded connections, said container and cap being releasably secured together at said connections, said cap having a liquid inlet port constructed for connection to a pressurized liquid source, and one of said container and cap having at least one liquid outlet port, and wherein each of said cap and said container is provided with a conical end seating seal, that seal associated with said cap being provided with aperture means for accommodating lateral fluid flow through said seal associated with said cap.

8. The structure of claim 7 wherein said aperture means is arranged for fluid flow directly longitudinally through said nap.

9. A paint roller cleaning device comprising a receptacle constructed to releasably receive a paint roller and having a container and a cap, each of said container and cap having threaded connections, said container and cap being releasably secured together at said connections, said cap having a liquid port constructed for connection to a pressurized liquid source, and one of said container and cap having at least one liquid outlet port, and wherein said cap has a perforate member provided with a positioning and sealing plug constructed for positioning with an end of said paint roller.

10. A paint roller cleaning device comprising a receptacle constructed to releasably receive a paint roller and having a container and a cap, a paint roller to be cleaned being temporarily disposed within the combination of said container and said cap, said paint roller comprising an inner tube and an outer nap secured thereto, each of said container and cap having threaded connections, said container and cap being releasably secured together at said connections, said cap having a liquid inlet port constructed for connection to a pressurized liquid source and communicating with said inner tube whereby to permit pressurized fluid conduction therethrough, and one of said container and cap having at least one liquid outlet port, and a pressurized liquid source coupled to said inlet port for urging fluid through said inlet port and longitudinally and circularly through said nap, to thus clean said roller nap and expel said liquid through said outlet port.

11. The structure of claim 10 wherein said nap engages the interior wall of said container.

12. A paint roller cleaning device comprising a receptacle constructed to releasably receive a paint roller and having a container and a cap, a paint roller to be cleaned being temporarily disposed within the combination of said container and said cap, said paint roller comprising an inner tube and an outer nap secured thereto, each of said container and cap having threaded connections, said container and cap being releasably secured together at said connections, said cap having a liquid inlet port constructed for connection to a pressurized liquid source, and one of said container and cap having at least one liquid outlet port, and a pressurized liquid source coupled to said inlet port for urging fluid through said inlet port and longitudinally and circularly through said nap, to thus clean said roller nap and expel said liquid through said outlet port, and wherein said receptacle has a spacer sleeve disposed between said container and said nap, and essentially engaging said nap.

* * * * *